United States Patent [19]

Komatsu et al.

[11] 4,368,461

[45] Jan. 11, 1983

[54] DIGITAL DATA PROCESSING DEVICE

[75] Inventors: Shigeru Komatsu, Yokohama; Kunihiko Nagai, Zushi; Takuo Koyama; Tsuguji Tachiuchi, both of Yokohama; Mikiaki Kobayashi, Kamakura; Toshiyuki Kurita, Yokohama, all of Japan

[73] Assignee: Hitachi, Ltd., Tokyo, Japan

[21] Appl. No.: 212,232

[22] Filed: Dec. 2, 1980

[30] Foreign Application Priority Data

Dec. 3, 1979 [JP] Japan ..... 54-155609

[51] Int. Cl.[3] ..... G09G 1/02

[52] U.S. Cl. ..... 340/703; 340/799; 364/900

[58] Field of Search ..... 364/200, 900; 340/703, 340/799

[56] References Cited

U.S. PATENT DOCUMENTS

| | | | |
|---|---|---|---|
| 4,232,311 | 11/1980 | Agnetta | 340/703 |
| 4,237,543 | 12/1980 | Nishio et al. | 340/799 X |
| 4,298,931 | 11/1981 | Tachiuchi et al. | 340/799 X |
| 4,303,986 | 12/1981 | Lans | 340/799 X |
| 4,310,838 | 1/1982 | Juso et al. | 340/799 X |

*Primary Examiner*—David L. Trafton

*Attorney, Agent, or Firm*—Antonelli, Terry & Wands

[57] ABSTRACT

A digital data processing device in which a color memory has a temporal data storage register at input/output interface thereof so that the data write-in or data read-out operations executed by a micro-processing unit (MPU) is always performed through the temporal storage register. When data read-out or write-in operation is made to a character memory at a certain address, the same operation is simultaneously carried out for the color memory at the corresponding address. Assuming that MPU reads out a certain display address of a display screen, a corresponding character code is fetched by MPU from the character memory, while the corresponding color code is transferred to the temporal storage register from the color memory. When MPU performs the write-in operation for another address of the display screen, the character code held by MPU until then is written in the character memory at a designated address, while the color data i.e. the contents currently held by the temporal storage register are written in the color memory at the address which corresponds to the designated address of the character memory. In this manner, the color data is simultaneously transferred through the software-based processing for transferring only the character code in appearance, whereby the transfer of the contents to be displayed on the display screen can be carried out with an enhanced efficiency.

7 Claims, 2 Drawing Figures

DIGITAL DATA PROCESSING DEVICE

BACKGROUND OF THE INVENTION

1. Field of the Invention

The present invention relates in general to a digital processing device provided with plural types or varieties of memories. In particular, the invention concerns an improvement in digital data processing devices in which the processing of a data transfer with plural types of memories can be accomplished at an increased speed.

2. Description of the Prior Art

In recent years, remarkable progress has been made in high-density integrated semiconductor circuit technology and there is now available commercially inexpensive large scale integrated circuits (LSIs) for electronic computers which incorporate a central microprocessing unit (hereinafter referred to as a MPU in abridgement) integrated on a single chip. Under the circumstances, an electronic computer of a very small size which is constituted by a MPU provided additionally with input/output devices and memory or memories for independent operation tend to be increasingly and widely used particularly for personal use or business applications of small scale. These electronic computers are usually equipped with a keyboard for the input device and a cathode ray tube display (hereinafter referred to as a CRT) for the output device. Information or data input through the keyboard as well as characters, graphs, charts or the like graphic patterns which are composed with the aid of programs are displayed on the display screen of the CRT. In view of the processing capability of these small scale computers and the manufacturing costs for the memories or the like, there is used dominantly the MPU which is capable of processing 8-bit data in parallel. In this connection, it is also known that the display screen of a CRT is divided into a large number of areas or sections, whereby the characters or graphs are displayed in color by allotting predetermined colors to the divided sections in the patterns corresponding to the characters or graphs to be displayed. In such a case, the display on a single area or section requires as many as sixteen bits in total of which eight bits are used for designating the type of alphabet or numeral to be displayed in that area or division, while the other eight bits are used for designating the color of the alphanumeric character and the background color displayed in the same divided area.

In order for the MPU of the eight-bit processing capability to be able to process the data of sixteen bits, a bank switching system may be adopted in combination with a plurality of memories for exchangeably selecting one of the memories for performing data transfer with MPU. In more particular, each data item of sixteen bits is divided into a character code of eight bits and a color code of eight bits, both codes then being separately stored in a character memory and a color memory, respectively. Under these conditions, the MPU performs alternate selection of one of the two memories and then effects the data transfer with the selected memory for every display division or area in a sequential manner.

By the way, in the case of a graphic display, it is often required that the contents to be displayed make an appearance in a so-called scrolling manner (e.g. a graph is displayed following a rising-up trace). In such case, the concerned data stored at a certain address in the memory has to be shifted from the certain address to another proper address which is spaced from the former by a predetermined number of addresses. Such being the circumstances, the data transfer executed for the data of sixteen bits for every display section or division requires a large number of processing steps including the operations of selecting a character memory, reading contents from the character memory at a given address, writing the read-out character code at the address distanced from the given address by a predetermined number of addresses, selecting a color memory, reading the contents from the color memory at a given address, and writing the read color data at an address spaced from the given address by a predetermined number of addresses. Such a data transaction will necessarily involve an intolerable time consumption.

Further, transient states during the transaction or transfer operations will disadvantageously be perceptible to the eye and the ear of the user or operator. Besides, the scrolling display cannot be produced in a natural manner.

SUMMARY OF THE INVENTION

An object of the invention is therefore to provide a digital data processing device which is capable of performing data transfers with a plurality of memories at a high speed.

In view of the above object, it is proposed according to a general aspect of the invention that a proper or individual register is provided for each of the plural memories except for one predetermined memory. When the micro-processing unit or MPU performs data transfer with the predetermined memory, the other memories conduct data transfer with the respective individual registers, to thereby make unnecessary the alternate memory selecting operation and allow the overall data transfer with the memories to be accomplished within a short time span.

DESCRIPTION OF THE PREFERRED EMBODIMENTS

Figure 1:
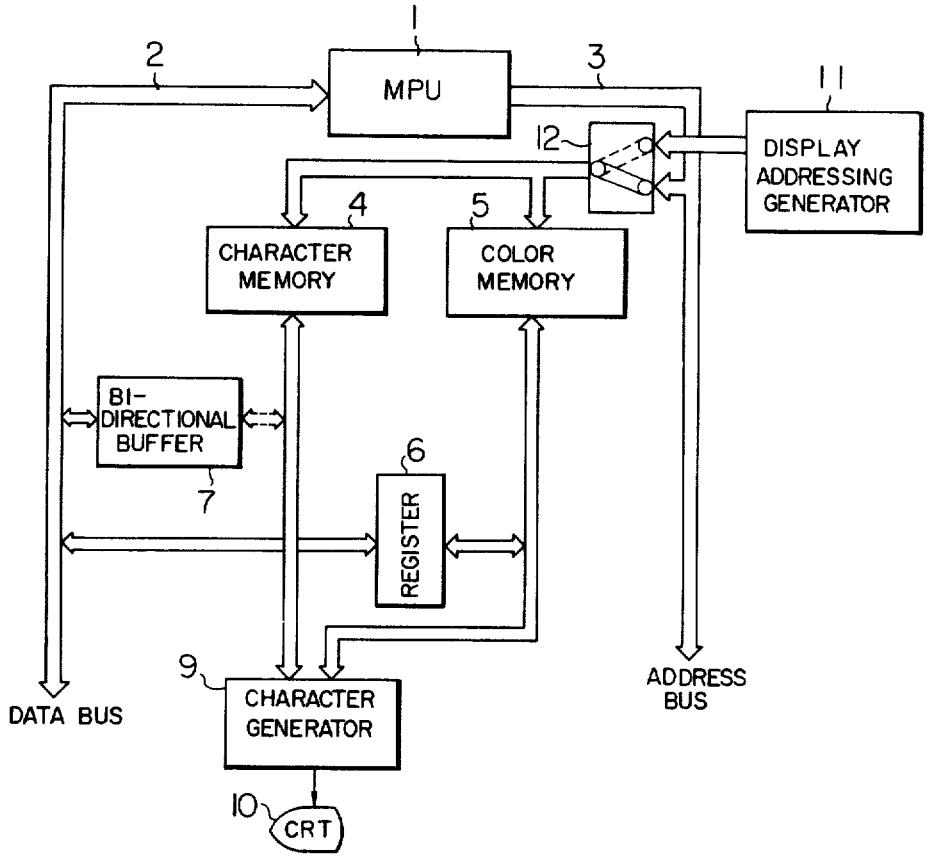
FIG. 1 is a block diagram showing an arrangement of a digital data processing device according to an embodiment of the invention.

Referring to FIG. 1 illustrating one embodiment of the invention, reference numeral 1 denotes a central micro-processing unit or MPU, 2 denotes a data bus, 3 denotes an address bus, 4 denotes a character memory, 5 denotes a color memory, 6 denotes a register, 7 denotes a bi-directional bus buffer, 9 denotes a character generating circuit, 10 denotes a color cathode ray tube or color CRT, 11 denotes a circuit for generating an address signal for display (hereinafter referred to as the display address generating circuit), and numeral 12 denotes a switching circuit. The switching circuit 12 is operated at a switching frequency of 1 MHz, for example. In the position of the switching circuit 12 indicated by a solid line in FIG. 1, the MPU 1 can designate the addresses of the character memory 4 and the color memory 5 for allowing character and color data to be written in or read out from these memories 4 and 5 at the respective designated addresses. On the other hand, when the switching circuit 12 is at the position indicated by a broken line in FIG. 1, the addresses of the character memory 4 and the color memory 5 from which a character code and a color code are to be read out are designated by the addressing signal issued from the address generating circuit 11, whereby a color character corresponding to the character code and the color code thus read out from the designated addresses of the memories 4 and 5 is displayed on the screen of the CRT 10 at the display location or division corresponding to the addressing signal through operation of the character generating circuit 9. In other words, when the switching circuit 12 is at the solid-lined position, the device is in the non-display mode in which the character memory 4 and the color memory 5 are activated by the MPU 1 for data writing and/or reading operation, while the broken-lined position of the switching circuit 12 corresponds to the display mode in which the character code and the color code to be displayed on the CRT 10 are read out from the character memory 4 and the color memory 5 at the respective addresses corresponding to the designated display division or section.

In the first place, description will be made on the reading and writing operations in the non-display mode in which the character memory 4 and the color memory 5 are activated from the MPU 1.

In the reading operation for reading out concerned codes from the character memory 4 and the color memory 5 under activation by the MPU 1, the character memory 4 and the color memory 5 produce at the respective outputs the character code and the color code from the respective memory addresses corresponding to the addressing signals supplied through the address bus 3 and the switching circuit 12 from the MPU 1. The character code output from the character memory 4 is sent onto the data bus 2 by way of the bi-directional buffer 7 to be read into the MPU 1. On the other hand, the color code output from the color memory 5 is placed in the register 6. When the MPU 1 wants to know the color code output from the color memory 5, information about the contents of the concerned color code is transmitted to the MPU 1 through the data bus 2.

In the case of the writing operation, the contents of a color code to be written in the color memory 5 is previously set in the register 6. The color code setting operation may be effected in two ways. First, the color code may be written in the register 6 directly from the MPU 1. As the alternative, the address of the color memory 5 at which the color code corresponding to the color to be displayed on the CRT display is located may be read out and placed in the register 6. When the register 6 has thus been set or loaded with the color code in any way, an associated character code is written in the character memory 4 from the MPU 1 through the data bus 2 and the bi-directional buffer 7. Simultaneously, the same address data as that of the character code to be written in the memory 4 as well as the write-in enabling signal is supplied to the color memory 6, resulting in the contents of the register 6 being transferred to the color memory 5 to be written therein. Next, interconnections and operations of the register 6 and the color memory 5 will be described below in detail by referring to FIG. 2 which shows in a block diagram a main portion of the arrangement shown in FIG. 1.

Figure 2:
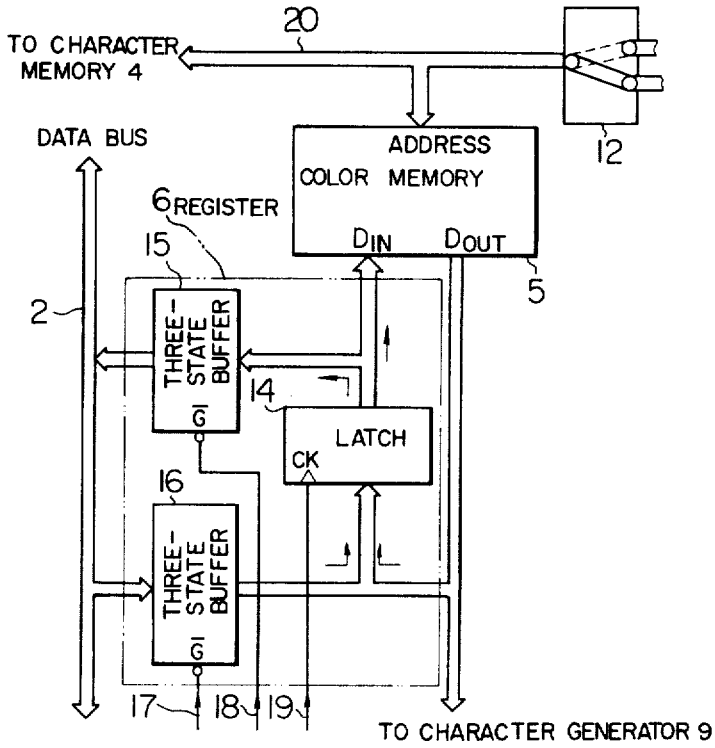
FIG. 2 is a block diagram showing a main portion of the digital data processing device shown in FIG. 1.

Referring to FIG. 2, reference numeral 14 denotes a latch circuit, 15 and 16 denote three-state buffers, respectively, 17 and 18 represent high impedance control signals, respectively, 19 represents a latch clock signal, and 20 denotes a memory address bus.

The latch circuit 14 is adapted to fetch the input data at the leading or rise-up edge of the latch clock signal 19. The timing of the latch clock signal 19 is so selected that the clock signal rises up when the writing operation to the character memory 4 and hence to the latch 14 is to be effected by the MPU 1 and additionally when the reading operation from the character memory 4 and hence from the color memory 5 is to be performed. Each of the three-state buffers 15 and 16 is so arranged that the output side thereof is disconnected from the input side when the control terminal $\overline{G}$ is at high "H" level, while at the low level "L" of the control terminal $\overline{G}$, the input signal composed of eight bits is transmitted to the output as it is . In this conjunction, it is to be noted that the control signal 17 is usually at the high or "H" level and is changed to the low or "L" level only when the write-in operation to the latch 14 is to be effected for allowing data on the data bus 2 to be applied to the latch circuit 14. In a similar manner, the control signal 18 is usually at the "H" level and changed over to the low or "L" level only when the read-out operation from the latch 14 is to be executed for allowing the signal output from the latch 14 to be sent to the data bus 2 through the buffer 15.

Since data transfer between the color memory 5 and the register 6 takes place simultaneously with the data transfer between the character memory 4 and the MPU 1, the data shift from one address to the other in one and the same memory as required for producing a scrolling display can be processed in quite the same manner as the case where no color memory 5 was provided, although both the character memory 4 and the color memory 5 are actually present. Thus, the data shift either in the character memory 4 or the color memory 5 can be performed with a very high efficiency.

As will be appreciated from the foregoing description, the MPU 1 is capable of processing even the data which includes a large number of bits beyond the parallel-processing capability of the MPU at substantially the same speed as that of the parallel processing.

In other words, the data transfer between the memory and the MPU can be effected at a speed twice or three times as high as the processing speed attainable with the aid of the hitherto known bank switching system, whereby substantially no appreciable flicker occurs on the display screen even in the course of data shifting.

Additionally, because the color data is not required to undergo alteration so frequently as the character data (e.g. the color data need not be altered for every displayed character in most cases), it is unnecessary to perform the write-in operation of the same color data for every write-in operation of the character code, once the color code common to the character codes has been set in the latch 14. Under these conditions, only the character data needs to be inputted, whereby the overall operation efficiency as well as the data writing speed can be significantly improved. Besides, the invention can be implemented relatively inexpensively to a further great advantage.

In the foregoing description of the preferred embodiment, it has been assumed that two types of memories i.e. the character memory 4 and the color memory 5 are employed. However, the invention is never restricted to such arrangement. It will readily be understood that the invention can equally be applied to a system where three or more types of memories are employed. In this case, it is only necessary to provide the register 6 for each of the memories other than the one which is destined to perform the data transfer with the MPU 1.

We claim:

1. A digital data processing device comprising:

a plurality of memory means each having a number of corresponding address locations at which data is selectively stored;

addressing means for simultaneously addressing the same address location in each of said plurality of memory means by application of a single address thereto;

a central processing unit connected to one of said memory means by means including a data bus for performing data transfer between said central processing unit and the designated address location of said one memory means;

individual register means each provided in association with each of said memory means except for said one memory means for storing data received from or to be supplied to its associated memory means; and means for effecting data transfer between each register means and the designated address location of each associated memory means simultaneously with data transfer between said central processing unit and said one memory means.

2. A digital data processing device as set forth in claim 1, further including a further data bus connected between said central processing unit and each of said register means and means for effecting data transfer therebetween via said further data bus.

3. A digital data processing device comprising:

(a) first memory means having a number of address locations at which data is selectively stored;

(b) a micro-processing unit including means for generating signals to designate an address location in said first memory means and perform data transfer for said designated address location;

(c) second memory means having a plurality of address locations designated with the same address as corresponding address locations of said first memory means; and (d) register means connected to said second memory means for effecting data transfer for said designated address location of said second memory means simultaneously with the data transfer between said micro-processing unit and said first memory means.

4. A digital data processing device as set forth in claim 3, wherein said micro-processing unit is adapted to perform data transfer between it and said register means.

5. A digital data processing device as set forth in claim 3 or 4, further including:

image display means;

display address generating means for generating addressing signals corresponding to divided display sections of said image display means;

drive means for displaying on said image display means at said display sections a color image in accordance with data read out from said first and second memory means at the addresses thereof designated by said addressing signal.

6. A digital data processing device comprising:

(a) a color display unit provided with a color display screen;

(b) a character memory for recording character codes for color images each to be displayed in each of a plurality of divided sections of said color display screen;

(c) a color memory for recording color codes for said color images;

(d) addressing means for generating display addressing signals corresponding to said divided sections of said color display screen;

(e) driving means for producing a color image in accordance with the character code and the color code stored at the same address location in said character memory and said color memory, respectively, designated by said display addressing signal, said color image being displayed at the divided display section corresponding to said display addressing signal;

(f) a micro-processing unit having a data bus connected to one of said character memory and said color memory;

(g) address signal switching means for changing over alternately the address signal issued from said micro-processing unit and the display addressing signal from said addressing means to each other for supplying said address signals alternately to both of said memories simultaneously; and (h) a register connected to the other one of said character memory and said color memory and adapted to store data which has been recorded in said other memory or which is to be recorded in said other memory at the designated address location.

7. A digital data processing device as set forth in claim 2, wherein each individual register means comprises latch means for storing data received from said central processing unit or said associated memory means, first buffer means connecting the input of said latch means to said further data bus to selectively apply data from said central processing unit to said latch means, the input of said latch means also being connected to said associated memory means for receiving data from said associated memory means, and second buffer means connecting the output of said latch means to said further data bus for selectively effecting transfer of data to said central processing unit, the output of said latch means also being connected to said associated memory means for effecting transfer of data thereto, said first and second buffer means being responsive to respective control signals from said central processing unit for controlling the conductive states thereof.

* * * * *